US006057759A

United States Patent [19]

Marsh

[11] Patent Number: 6,057,759

[45] Date of Patent: May 2, 2000

[54] MARINE PERSONNEL MONITORING, OVERBOARD DETECTION, ALERT AND RESCUE SYSTEM

[76] Inventor: Matthew T. Marsh, 5980 Richmond Hwy., Apt. 809, Alexandria, Va. 22303

[21] Appl. No.: 09/250,896

[22] Filed: Feb. 16, 1999

Related U.S. Application Data

[63] Continuation of application No. 08/735,137, Oct. 22, 1996.

[51] Int. Cl.[7] ..... G08B 1/08

[52] U.S. Cl. ..... 340/539; 340/573.1; 340/572.1; 340/604; 440/1

[58] Field of Search ..... 340/573.1, 539, 340/573.4, 604, 573.6, 506, 693, 605; 307/9.1; 440/1

[56] References Cited

U.S. PATENT DOCUMENTS 5,245,314 9/1993 Kah ..... 340/539
5,650,770 7/1997 Schlager et al. ..... 340/573

*Primary Examiner*—Daryl Pope

*Attorney, Agent, or Firm*—Joseph J. Zito

[57] ABSTRACT

A system for detecting and locating overboard personnel of a vessel. The system includes a plurality of transmitter units and an onboard receiver. A transmitter is assigned to be worn by each person to be monitored by the system. Each transmitter provides a unique identifier signal to the onboard receiver. The onboard receiver is initialized to establish an initial identifier configuration. The onboard receiver then continuously monitors its reception to detect any change in said initial identifier configuration. The onboard receiver triggers an alert in the event of detection of a change in said initial identifier configuration. In a first embodiment the assigned transmitters are activated prior to establishing the initial identifier configuration and the initial identifier configuration consists of all active transmitter identifiers present. In this first embodiment, the alert condition is initiated upon a failure of receipt of one of the identifiers. In a second embodiment, none of the transmitters are activated until it is submerged, the initial identifier configuration consists of no transmitter identifiers present. In this second embodiment, the alert condition is initiated upon receipt of a transmitter identifier. The system can also include a real time clock to record the time of an alert condition and/or a satellite positioning system to record the location of an alert.

18 Claims, 4 Drawing Sheets

MARINE PERSONNEL MONITORING, OVERBOARD DETECTION, ALERT AND RESCUE SYSTEM

RELATED APPLICATIONS

This Application is a continuation of application Ser. No. 08/735,137 filed Oct. 22, 1996.

BACKGROUND OF INVENTION

1. Field of the Invention

The present invention relates to nautical systems for the detection and location of man overboard and related conditions including, inboard monitoring, overboard monitoring and combined monitoring. More specifically, the present invention relates to the monitoring of a vessel's personnel, crew, passengers and/or cargo with the ability to detect changes in monitored conditions and to provide an indication of the time of any change and the location of the vessel at the time of the change in monitored condition.

2. Description of Prior Art

A man overboard condition can include the loss of a vessel's personnel, crew, passengers and/or cargo. A significant danger in traveling by water is the loss of life and property due to the loss of persons or articles which fall overboard from a vessel. It is not uncommon, especially on large vessels, for a man-overboard to remain unnoticed for a significant period of time. The likelihood of successful rescue decreases significantly if a man-overboard is not located soon after entering the water. The length of time and urgency of rescue is affected by many factors, including sea temperature, predator infestation and weather.

Several devices have been proposed to aid in detection of a man-overboard, including the personal ocean security system of U.S. Pat. No. 4,549,169 which teaches transmitters operating within a narrow frequency band so as to assure suppression of the transmission when submerged. Each transmitter continually transmits to a monitoring station, or, in one embodiment, responds to an encoded interrogation signal from the monitoring station. When a person falls overboard, the transmitter is submerged, and thus the monitoring station receives no more signals from it, thereby indicating that the person is in the water.

The safety alert and locating system of U.S. Pat. No. 4,813,025 combines detection and location by a combination of interrogation and response signals transmitted through both air and water, received by spaced antenna on the vessel to measure both elapsed time and incoming phase angles to determine distance and angle. The system automatically determines when a person under safety surveillance has exceeded safety limits from a base location.

The apparatus of U.S. Pat. No. 3,588,858 includes a radio transmitter actuated by a position sensitive switch, to create an alert or alarm situation when a person is in an abnormal position. The system of U.S. Pat. No. 4,305,143 includes an ultrasonic transmitter actuated by a hydrostatic switch, to send ultrasonic signals through die water to a receiver on the boat.

In U.S. Pat. No. 4,442,426 a monitoring system is shown in which a plurality of remote transmitter stations send signals to a central monitor in time staggered sequence. Each signal may be coded to identify the remote transmitter. When a danger situation arises, an alarm signal is sent without delay, breaking into the sequential pattern and thus informing the central monitor of an alarm condition.

Several devices have also been proposed to aid in location of a man-overboard, including U.S. Pat. No. 5,408,238 which teaches an apparatus with a GPS receiver which rebroadcasts its GPS coordinates to provide location information. The device is not attached to an individual nor automatically deployed. It is large and must be manually tossed into the water after an emergency condition is identified.

U.S. Pat. No. 5,274,359 teaches a portable water activated alert system with directional indicator which utilizes a directional antenna to receive a signal from a water activated transmitter to guide the vessel back toward the overboard transmitter.

There are also a number of patents which teach various water activated switches, for example U.S. Pat. No. 4,068,221, immersion responsive sensor and U.S. Pat. No. 5,408,222 submersion warning device and U.S. Pat. No. 5,138,300 water immersion alarm system.

In all of the foregoing prior art patents, an alarm or danger condition is indicated when it occurs, and, in some instances, the central station is capable of taking some sort of rescue or danger alleviating action. None of the patents shows a system capable of recording an exact time and location of the incident for rapid and effective rescue. Any of the systems which do provide location information do so as a location relative to the vessel and rely upon continued reception of a signal from the individual transmitter to maintain that location information, however, continued transmission can be unreliable when the vessel is traveling away from the lost individual.

SUMMARY OF INVENTION

The system of the present invention combines detection, location and notification of overboard personnel who have entered the water from a vessel. The system includes a plurality of portable transmitter units and an onboard receiver. A transmitter is assigned to be worn by each person to be monitored by the system. Each transmitter provides a unique identifier signal to the onboard receiver. The signal can also include one or more status codes. The onboard receiver is initialized to establish an initial identifier configuration. The initial configuration can be reception of one or more identifiers, or in the configuration of overboard detection only, the initial configuration is established as reception of no identifiers. The onboard receiver then continuously monitors its reception to detect any change in said initial identifier configuration. A change is detected when an identifier signal is either missing from the original configuration, or presents a different code to the receiver. In the configuration of overboard detection only a change is detected when the receiver begins to receive an identifier signal from a transmitter. The onboard receiver triggers an alert in the event of detection of a change in the initial identifier configuration.

In a first embodiment which is oriented toward short duration use such as recreational boating because the transmitters remain on for monitoring, the assigned transmitters are activated prior to establishing the initial identifier configuration and the initial identifier configuration consists of all active transmitter identifiers present. When a transmitter enters the water, its transmission is terminated. In this first embodiment, the alert condition is initiated upon a failure of receipt of one of the identifiers. If the transmitter does not stop transmission upon entry into water, the system provides for fail safe detection because an alert condition will still result when the transmitter moves out of range of the onboard receiver.

In a second embodiment, designed for long duration use such as commercial marine applications and for battery conservation, none of the transmitters are activated until submerged, the initial identifier configuration consists of no transmitter identifiers present. In this second embodiment, the alert condition is initiated upon receipt of a transmitter identifier.

In a third embodiment (onboard verification), the assigned transmitters are activated prior to establishing the initial identifier configuration and the initial identifier configuration consists of all active transmitter identifiers present. Each transmitter sends an identifier and a code indicating onboard status of the transmitter. When a transmitter enters the water, the onboard code for the submerged transmitter is no longer transmitted. If the transmitter does not stop transmitting the onboard code in response to immersion, the system provides for fail safe detection because an alert condition will still result when the transmitter moves out of range of the onboard receiver.

In a fourth embodiment, (overboard detection) the transmitters broadcast an alert code indicating a man overboard condition when submerged. In this fourth embodiment, the alert condition is initiated upon receipt of the alert code from a transmitter.

In a fifth embodiment (combined verification/detection), the transmitters are activated prior to establishment of the initial identifier configuration, as with the first embodiment. However, the transmitters continue to transmit and provide a unique identifier signal even after entry into the water. In this embodiment, the transmitter also provides a code indicating either onboard operation when dry or alert status when submerged.

In any embodiment, each transmitter is provided with a water activated switch which either begins transmission upon entry into water, terminates transmission upon entry into water, or initiates an alert code upon entry into water, as appropriate for the operational mode. The transmitter can also optionally be provided with a manual override panic button or manual alert switch to transmit an alert when operated by an individual. The manual alert switch allows for signaling an alert without reliance on the water actuated switch. The transmitter can also include a selector switch so that the individual can choose between automatic/manual/or combined alert actuation. In certain weather or nautical conditions, the personnel may become significantly exposed to water or even immersed without actually being overboard, such as high seas, gales or certain sailing or racing situations. It may be desirable in such conditions to disable the water activated switch and instead select manual operation. In other situations it may be desirable to select combined alert to provide added security. In the continuous monitoring embodiments, the out-of-range detection would remain as a backup to the manual alert switch. In the transmission only after immersion embodiments, the manual alert switch acts as an additional opportunity to ensure that an alert is registered before the vessel is out-of-range in the event of a potential delay in operation of the water sensitive switch.

The transmitters can be designed to transmit at predetermined regular timed intervals. Activation of the alert can be delayed by requiring the receipt/absence of a predetermined number of signals prior to confirmation of the alert condition.

In a further embodiment of the system, the receiver can include a real time clock to record the time of detection of any alert condition. The receiver can also include an interface to a satellite navigational system to record the global position of the vessel at the time of an alert. Optionally, the RF receiver can be linked to a satellite positioning system such as a Global Positioning System (GPS) receiver or a Global Orbital Navigational System (GLONASS) receiver, through an interface. The RF receiver will record the GPS/GLONASS location at the time of activation based upon the detection of the immersion of a transmitter.

The transmitter can optionally be provided with visual/audible signaling apparatus such as a strobe or beacon to aid in rescue efforts. The signaling device is activated by the water actuated switch. The addition of a visual or audible signal device reduces the risk of injury during rescue in low visibility conditions.

The present invention assists in successful rescue by providing rapid, accurate and reliable notification and location information. The transmitter notifies the receiver at the time of entry into the water. The RF receiver will note and record the time of activation and the elapsed time since activation. The rapid notification allows for rapid rescue of the individual avoiding the need for long term search and the dangers of prolonged exposure. During search and rescue, the strength of a received signal can provide added verification that rescuers are approaching the lost individual.

The present invention allows for rescue by any vessel because of reference to an absolute location and not a location relative to the original vessel. The distance traveled by the vessel after the man overboard will not adversely impact location efforts because continued detection of the signal is not necessary for rescue. With the present invention, rescue can be initiated at any distance, without the need for reception of a transmitter signal. This has the distinct advantage over prior systems of avoiding a search in the wrong direction when out of range of the transmitter signal.

Each transmitter unit contains a transmitter circuit, a water sensitive switch, and a battery and can also include an optional visual/audible signaling device. Each transmitter within a system has a unique identifier signal recognized by the onboard receiver. During onboard verification operation, each such portable transmitter sends packages of data, consisting of a unique identifier, a battery status, and an operational status flag, to an onboard receiver. In such normal operation, the status flag of the receiver signals a no-alert or onboard condition. If a transmitter unit is powered "off", that unit sends the package of data with flag indicating that the transmitter is going off-line. An alert condition is triggered during onboard verification if the identifier signal of any unit is not received for a predetermined interval.

Overboard detection is accomplished when the water sensitive switch of a given transmitter is activated, causing a package of data indicating an alert to be sent to the receiver. In this event, the emergency locator transmitter can also activate its associated signaling device and continue to transmit the alert code.

Combined onboard verification and overboard detections relies upon continuous receipt of a signal from each transmitter, providing redundancy and therefore increasing reliability of detection.

The receiver unit is a stationary onboard device that monitors one or more of the personal transmitter units. It contains a power supply, a receiver circuit, an alarm, a display panel, an optional battery backup and an optional external/internal GPS interface. During its onboard verification operation, the receiver receives packages of data from respective transmitters, confirming onboard condition. In combined verification/detection operation, the receiver receives packages of data from respective transmitters, confirming either onboard or alert condition. In the event an off-line flag is received by the onboard receiver, it notes the action and stops expecting packages from a given transmitter unit. In the event a new on-line sequence is activated, the receiver unit senses an added transmitter unit and begins expecting regular packages therefrom.

In the event an alert code is received, the receiver unit identifies the transmitter unit which has provided the alert code, activates the alarm, and pulls critical data from the GPS and real time clock. The alarm continues to sound until disabled by an onboard receiver operator. In the event a predetermined number of transmissions have been missed, the onboard receiver unit sends out a caution message, indicating no transmission from the unit. After continuing to receive no transmissions, the alert mode for the transmitter will activate.

DESCRIPTION OF PREFERRED EMBODIMENTS

Figure 1:
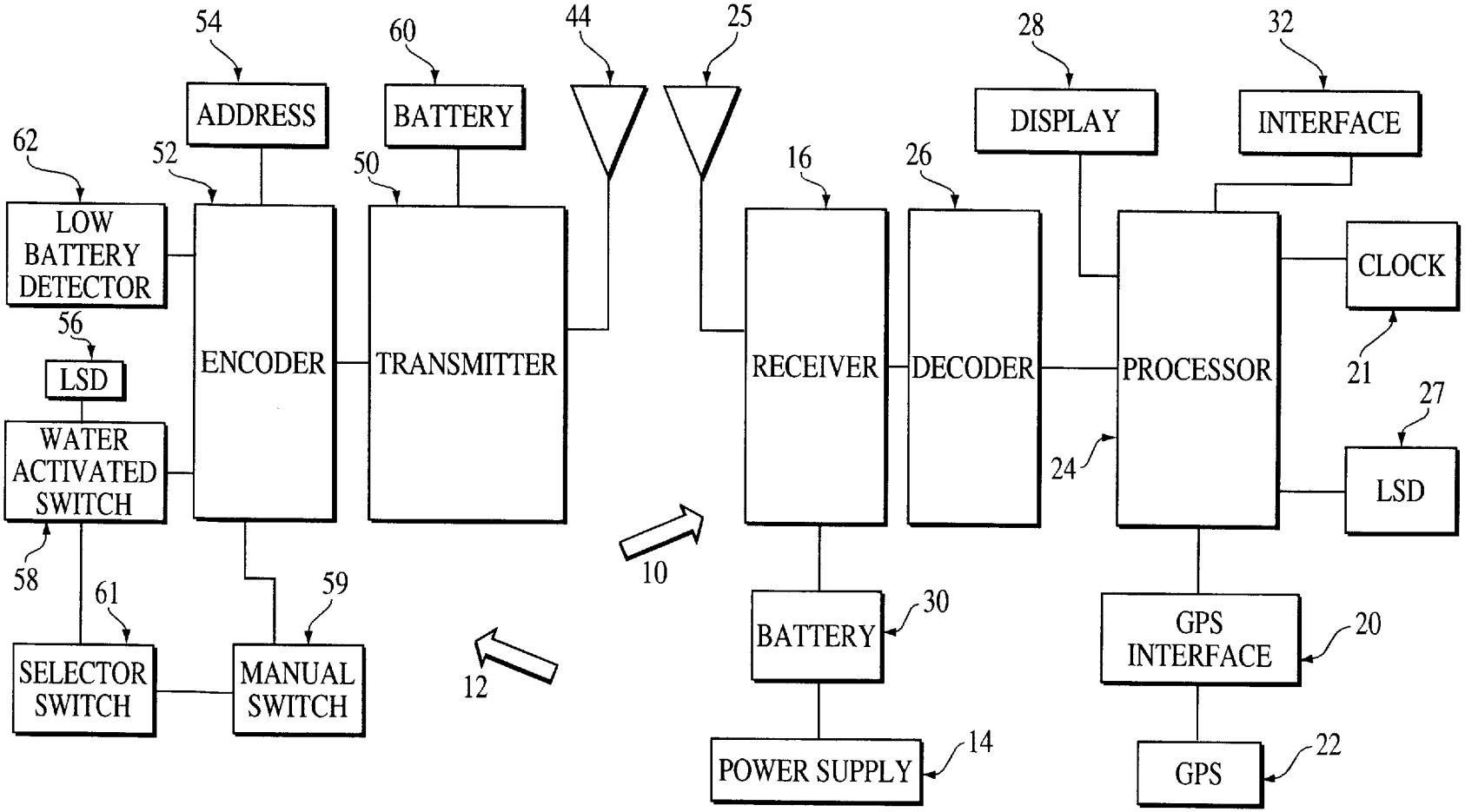
FIG. 1 is a block diagram of the system of the present invention, illustrating a transmitter unit and an onboard receiver, in accordance with the invention.

As illustrated in FIG. 1, the onboard receiver 10 monitors one or more of the portable transmitter units 12. It contains a power supply 14, a receiver circuit 16, a decoder 18. The onboard receiver 10 also includes a processor 24 with associated alarm 27, display panel 28, battery backup 30 and optional real time clock 21 and external interface 32 and optional associated GPS interface 20 operatively connected to external or internal GPS 22.

The transmitter unit 12 is a device which persons wear while onboard a marine vessel. It contains a transmitter circuit 50, encoder 52 with associated address 54, a signal device 56, water sensitive switch 58, and power supply battery 60 with low-battery detector 62. The transmitter 12 can also include an optional manual switch 59 and/or selector 61.

The overall communication system can detect conditions by three different means, namely: onboard verification, overboard detection and combined verification/detection. While the hardware of these units may be similar, the firmware and detection means may have elements or differing operational characteristics within the scope of the invention.

Upon the power "on" mode, the onboard receiver 10 initialize its circuitry and runs through a brief self test sequence, testing all output devices/alarms including display 28 and signal device 27. After the self test, this onboard receiver 10 handshakes with the GPS 22 to confirm communications and starts looking for valid data transmissions from transmitter unit(s) 12.

Figure 2:
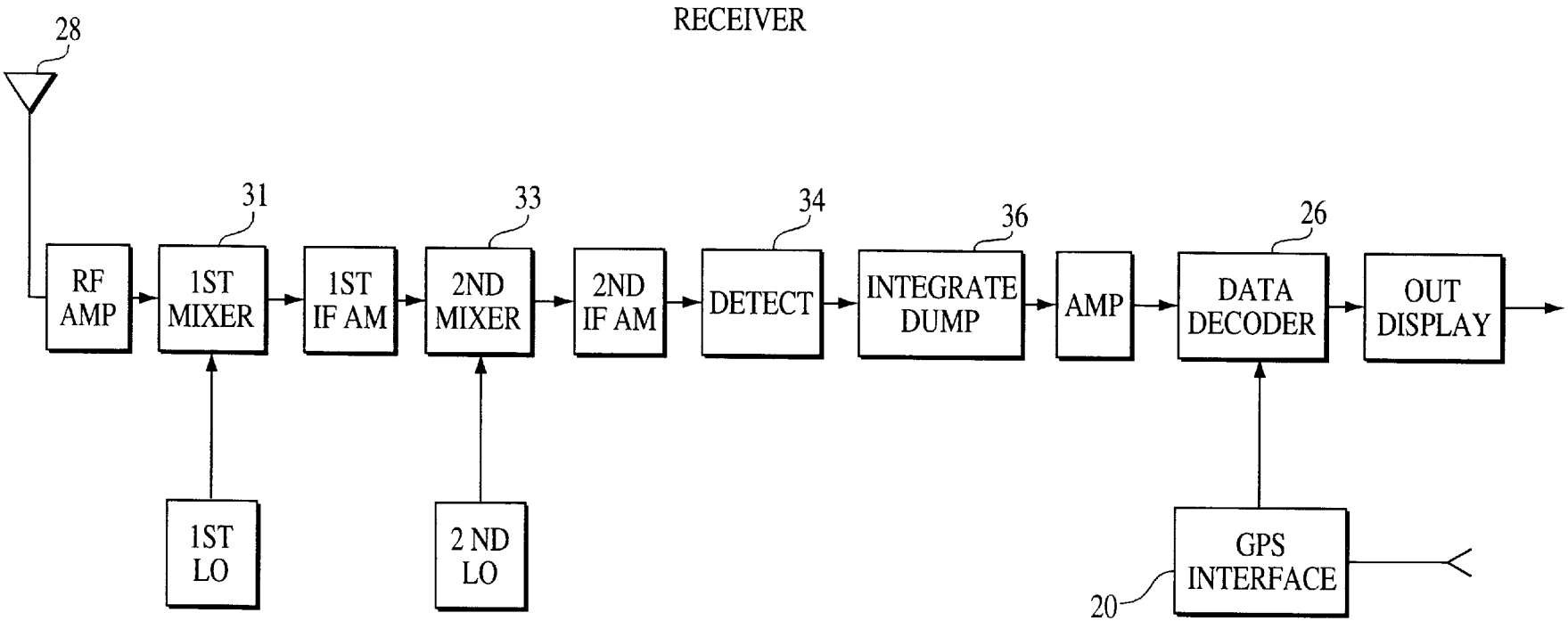
FIG. 2 is a detailed block diagram of an onboard receiver of the present invention.

Referring to FIG. 2, upon receipt of a transmission, the information is processed through the onboard receiver 16 in a normal manner consistent with standard dual conversion superheterodyne technology. Image rejection is accomplished at a first mixer 31 and bandwidth is addressed at a second mixer 33. After intermediate frequency gain block and detection 34 the information (data) is processed through an integrate and dump stage 36 for the purpose of enhancing the low level signal characteristics of the receiver. Output of an integrate and dump circuit is amplified and passed on to the data decoder 26.

Figure 3:
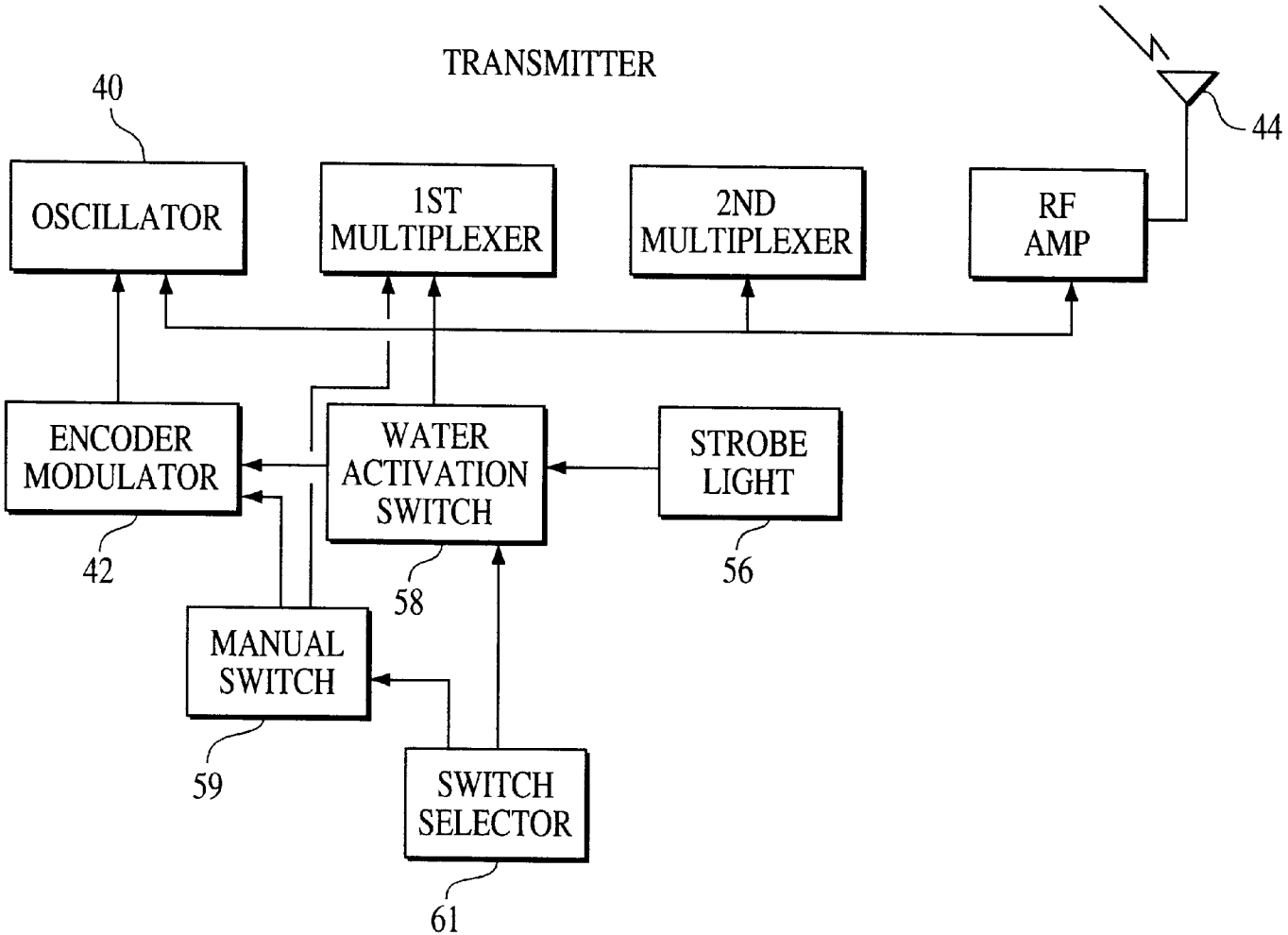
FIG. 3 is a detailed block diagram of a transmitter of the present invention.
Figure 4:
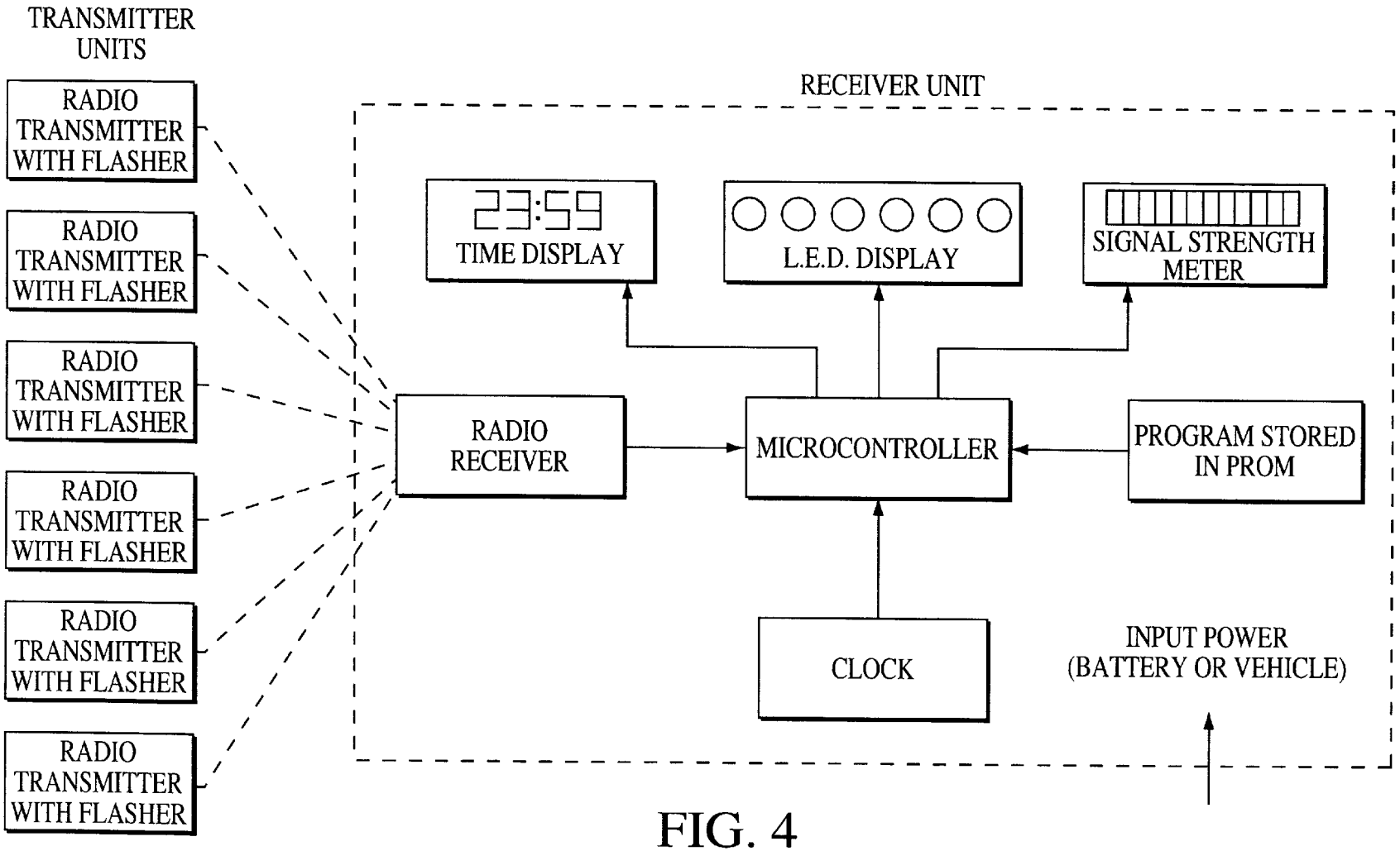
FIG. 4 illustrates a number of transmitters associated with a common receiver in accordance with the teachings of the present invention.

As illustrated in FIG. 3, the exemplary portable transmitter unit 12 utilizes a crystal controlled oscillator 40 which is frequency modulated by its encoder 42. The modulated signal is amplified and tripled twice to achieve a carrier frequency in the 900 MHz range. This frequency is amplified sufficiently to drive the antenna 44.

In the onboard monitoring embodiments, the system components function in the manner described below. The exemplary data decoder functions as follows:

A. At power "on" initialization, the onboard receiver verifies communication with its GPS receiver by handshaking.

B. Verifies initial receipt of valid transmitter identifier signal(s).

C. Sets a countdown timer to expect subsequent transmissions.

D. Re-sets the timer upon receipt of subsequent transmission(s).

E. Sets an output flag when a subsequent transmission is missed.

F. Issues a preliminary alarm when "N" number of transmissions have been missed.

G. Requests a GPS time/date/location stamp when one of the following occurs:
   1. a valid alert code has been received from a transmitter.
   2. a predetermined "N+" number of transmissions have been missed.

H. Issues an alarm when:
   1. a valid alert code has been received from a transmitter, or.
   2. a predetermined "N+" number of transmissions have been missed.

I. stops anticipating transmissions from a transmitter when a valid shut down code has been received.

J. Issues a low battery alert when a low battery alarm is received from the transmitter.

At power "up" the transmitter outputs a data stream produced by the encoder consisting of the following encoded signal information:

A. Sync string

B. Framing character

C. Unit ID

D. Battery status

E. Onboard flag

F. Framing character

This information is retransmitted at predetermined timed intervals for the onboard verification operation.

When the transmitter power switch is turned "off", the transmitter outputs the following encoded signal information before shutting down:

A. Sync string

B. Framing character

C. Unit ID

D. Battery status

E. Power off flag

F. Framing character

In systems where overboard detection is enabled, when the transmitter water sensitive switch 58 is activated, the transmitter 12 will issue the following encoded signal information:

A. Sync string

B. Framing character

C. Unit ID

D. Battery status

E. Alert flag

F. Framing character

This information provides the alert notification for overboard detection operation and/or combined verification/detection.

During normal marine vessel operation, each transmitter 12 sends packages of data, consisting of a unique identifier, a battery status, and an onboard status flag, to the onboard receiver. In normal sailing operation, the status flag of the onboard receiver signals a no-fault condition. If a transmitter unit 12 is powered "off," it sends the package of data with a flag indicating that the transmitter is going off line.

In the event an off-line flag is received, the onboard receiver 10 notes the action and stops expecting packages from respective transmitter units 12. In the event a new on-line sequence is received, the processor of the onboard receiver unit 10 senses the new transmitter 12 and the onboard receiver 10 begins expecting regular data packages. In the event a predetermined number of transmissions have been missed, the onboard receiver 10 sends out a caution message, indicating no transmission from the personal transmitter unit 12 and after continuing to receive no transmissions from the transmitter 12, the alert mode for that transmitter 12 will activate. The alert mode thus activates an alarm, pulls data from the GPS, and enables the audible/visual signal on the external passenger transmitter device 12. The alarm continues to sound until disabled by an onboard receiver operator.

In the overboard detection method, the transmitter transmits an alert signal when its unit contacts water, thus activating an alarm, pulling data from the GPS, and enabling the LSD alarm on the external transmitter output. The alarm continues to sound until disabled by an onboard radio operator. After the alarm is disabled disabled, the onboard unit begins searching for the unique identifier of that unit. After being disabled, and unless logged out at the onboard receiver, the onboard receiver continues its search for a transmitted packet from the transmitter unit 12. Also, in the event the personal transmitter is out of range, the onboard receiver continues in the search loop. When located, this receiver's display data is updated, a different alarm signal is activated, and the external transmitter driver output is updated.

In the overboard detection only embodiments, described above, the system components function in the manner described below. The exemplary data decoder functions as follows:

A. At power "on" initialization, the onboard receiver verifies communication with its GPS receiver by handshaking.

B. Verifies no initial receipt of valid transmitter identifier signal(s).

C. Issues a preliminary alarm when a valid transmitter identifier signal is detected D. Requests a GPS time/date/location stamp when a valid identifier signal has been received from a transmitter.

E. Issues an alarm when a predetermined "N" number of transmissions have been received.

Power up of the transmitter units 12 in an overboard detection only system occurs only upon actuation of the water detection switch 58 of a transmitter. At power "up" the transmitter outputs a data stream produced by the encoder consisting of the following encoded signal information:

A. Sync string

B. Framing character

C. Unit ID

D. Battery status

E. Alert flag

F. Framing character

This information is retransmitted at predetermined timed intervals for the overboard detection operation. This information provides the alert notification for overboard detection operation and/or combined verification/detection.

As described above, a mode of operation for providing combined onboard verification and overboard detection, is also taught. During normal marine operation, the onboard receiver receives packages of data from the transmitter 12, in the onboard verification manner described above, confirming proper operation. In the event an off-line flag is received, the onboard receiver 10 notes the action and stops expecting packages from one or more of the transmitter units 12. In the event a predetermined number of passenger transmissions have been missed, the onboard receiver unit 10 sends out a caution message, indicating no transmission. After continuing to receive no transmissions from the transmitter 12 or when an alert data package is received from the transmitter 12, the alert mode for that transmitter 12 will activate. The alert mode of the personal transmitter 12 thus activates the audible/visual signal alarm 56, pulls data from the GPS 22, and enables the onboard alarm 27. The alarm 27 continues to sound until disabled by an onboard operator.

The above marine man overboard search and rescue communication described composite arrangement has thus been shown to provide an improved system which supervises and integrates the coactive functioning of onboard verification, overboard detection and combined verification, providing unique search and rescue data thus enabling most secure marine transit to passengers and crew alike.

The above described is merely illustrative of the principles of the present invention. Numerous modifications and adaptations thereof will be readily apparent to those skilled in the art without departing from the spirit and scope of the present invention.

What is claimed is:

1. A system for detecting and locating overboard personnel of a vessel, comprising:

a plurality of transmitter units to be worn by monitored personnel, each unit including a signal circuit for transmitting a unique identifier signal to said transmitter unit, each transmitter unit further including a deactivator switch for terminating transmission of said unique identifier signal upon entry of said transmitter into water;

an onboard receiver for receiving and monitoring said unique identifier signal, and for establishing an initial identifier configuration indicative of said transmitter unit identifier signals received by said onboard receiver based upon said monitoring, said receiver configured for detection of any change in said initial identifier configuration, resulting from deactivation of one of said plurality of transmitter units;

an alert device operatively connected to said receiver to alert the crew of said vessel to any detected change; and said transmitter unit further comprising a selector switch for choosing an alarm status of said transmitter selected from the group consisting of onboard, overboard and combined verification and detection, wherein said selection generating separate automated signals to said receiver for alarm generation.

2. The system of claim 1, wherein:

each of said transmitter units includes a deactivator for terminating transmission of said unique identifier signal upon entry of said transmitter into water.

3. The system of claim 1, wherein said receiver includes a real time clock and a recorder to detect, record and provide the time of detection of any said detected change in initial identifier configuration.

4. The system of claim 1, wherein said receiver includes an interface to a satellite navigational system and recorder to detect, record and provide the global position of the vessel at the time of receiving said detected change in initial identifier configuration.

5. The system of claim 1, further including:

a real time clock, an interface to a satellite navigational system and a recorder operatively connected to said receiver to detect, record and provide the time and global position of the vessel at the time of any said detected change in initial identifier configuration, wherein:

said receiver is triggered into a search and retrieve mode at the time of detection of any said detected change in initial identifier configuration, said search and retrieve mode including collection of information relative to the time and location of the detected configuration change and notification of crew members of the vessel.

6. The system of claim 1, wherein:

said identifier signal is transmitted until said transmitter encounters an alert condition triggering deactivation of said signal transmission and wherein said identifier signal is reactivated after a predetermined time period to aid in relocation of the transmitter.

7. The system of claim 1, wherein:

said onboard receiver further includes a display for displaying said initial identifier configuration.

8. The system of claim 1, wherein:

said onboard receiver further includes a reset to allow a user to establish a new initial identifier configuration.

9. The system of claim 6, wherein said identifier signal is reactivated after a predetermined time period to aid in relocation of the transmitter during a search and retrieve mode.

10. The system of claim 1, wherein selection of said switch to an onboard alarm status activates a preliminary alarm when a predetermined number of transmission signals have been missed by said receiver.

11. The system of claim 10, wherein said receiver generates an alarm code upon receiving a valid alert code from said transmitter.

12. The system of claim 10, wherein said transmitter generates an alarm when a predetermined number of transmission signals have been missed by said receiver.

13. The system of claim 1, wherein said transmitter unit further comprising a manual alert switch for transmitting an alert to said receiver.

14. The system of claim 1, wherein selection of said switch to an overboard status communicates with said receiver to stop expecting periodic signals from said transmitter unit.

15. The system of claim 14, wherein said receiver activates a preliminary alarm when a valid transmitter identifier signal is detected upon submersion of said transmitter in water.

16. The system of claim 1, wherein upon selection of said switch to a combined verification/detection status said transmitter unit continues to provide a unique identifier signal in both an overboard and an onboard environment.

17. The system of claim 16, wherein said transmitter unit provides a code indicating onboard operation when dry.

18. The system of claim 16, wherein said transmitter unit providing an alert status when submerged.

* * * * *